US007848696B2

(12) United States Patent
Peng et al.

(10) Patent No.: US 7,848,696 B2
(45) Date of Patent: Dec. 7, 2010

(54) IMAGE FORMING APPARATUS

(75) Inventors: Youbao Peng, Hino (JP); Utami Soma, Hachioji (JP); Atsushi Takahashi, Akishima (JP)

(73) Assignee: Konica Minolta Business Technologies, Inc. (JP)

( * ) Notice: Subject to any disclaimer, the term of this patent is extended or adjusted under 35 U.S.C. 154(b) by 986 days.

(21) Appl. No.: 11/699,282

(22) Filed: Jan. 26, 2007

(65) Prior Publication Data

US 2007/0264066 A1 Nov. 15, 2007

(30) Foreign Application Priority Data

May 15, 2006 (JP) ..... 2006-135342

(51) Int. Cl.
*G03G 15/00* (2006.01)

(52) U.S. Cl. ..... 399/395; 399/381; 399/388; 399/389; 399/394; 399/396; 399/401; 399/402; 271/226; 271/227; 271/228

(58) Field of Classification Search ..... 399/381, 399/388, 389, 394, 395, 396, 401, 402; 271/226, 271/227, 228

See application file for complete search history.

(56) References Cited

FOREIGN PATENT DOCUMENTS

| | | | |
|---|---|---|---|
| JP | 10115954 A | * | 5/1998 |
| JP | 10319674 A | * | 12/1998 |
| JP | 2000305324 A | * | 11/2000 |
| JP | 2003156974 A | * | 5/2003 |
| JP | 2004279749 A | * | 10/2004 |

* cited by examiner

*Primary Examiner*—Judy Nguyen
*Assistant Examiner*—Andy L Pham
(74) *Attorney, Agent, or Firm*—Squire, Sanders & Dempsey L.L.P.

(57) ABSTRACT

The invention provides an image forming apparatus wherein, when forming an image on transfer sheet, the transfer sheet is shifted across the width immediately before transfer of the image onto transfer sheet based on the position of a toner image formed on an intermediate transfer member as an image carrier, and the misalignment across the width is adjusted, thereby ensuring high-speed and high-precision adjustment of the position of the image formed on a single side or both sides.

1 Claim, 8 Drawing Sheets

FIG. 3 ( A )
TRANSFER SHEET P
(FRONT SURFACE)
DIRECTION OF SHEET
CONVEYANCE
A12
REVERSING
FIG. 3 ( B )
33
DIRECTION OF
IMAGE SHIFT
A11
32
FIG. 3 ( C )
TRANSFER SHEET P
(REAR SURFACE)
M
21
DIRECTION OF
SHEET
CONVEYANCE
CENTER
23A
23B
X
Y
ΔZ
A12
22

FIG. 6 ( B )
TRANSFER SHEET P
CENTER
ΔZ
M
21
23A
23B
22
X1
X2
ΔX
DIRECTION OF SHEET CONVEYANCE
Y1
Y2
ΔY
FIG. 6 ( A )
B1
B2
33
DIRECTION OF IMAGE SHIFT
32
A21
A22

IMAGE FORMING APPARATUS

This application is based on Japanese Patent Application No. 2006-135342 filed on May 15, 2006, in the Japanese Patent Office, the entire content of which is hereby incorporated by reference.

BACKGROUND OF THE INVENTION

1. Field of the Invention

The present invention relates to an image forming apparatus such as a photocopier and printer, particularly to an image forming apparatus for forming an image by correcting the position of transfer sheet in the direction perpendicular to the direction of conveying the transfer sheet.

2. Related Background Art

An image forming apparatus such as a photocopier and printer is provided with an image carrier, image writing section, development apparatus, sheet feed cassette, image transfer section, and fixing apparatus as well as an automatic conveyance apparatus for conveying sheets along a predetermined path. This automatic conveyance apparatus contains a plurality of conveyance rollers and motors, so that the transfer sheet is conveyed from upstream to downstream sides.

After an image has been formed on one side (front surface) of the transfer sheet, the transfer sheet is led through a reversing roller and reversing sheet conveyance path, whereby an image is formed on the other side (rear surface).

Further, to print a color image, four image forming units of yellow, magenta, cyan and black are arranged parallel to one another, and a toner image of each of the yellow, magenta, cyan and black colors formed sequentially by each of these image forming units is transferred to an image carrier on a primary basis. In this case, an intermediate transfer belt is often used as the image carrier. The toner image in the sense in which it is used here refers to the image formed on each photoreceptor of the corresponding image carrier by a developing device of each color. The toner image of each color is once transferred on an intermediate transfer belt (primary transfer), and a toner image is formed. After that, the image is transferred collectively from this intermediate transfer belt on transfer sheet (secondary transfer). Then the image formed on this transfer sheet is fixed, whereby a full-color or black-and-white image is formed.

In such an image forming apparatus, assume, for example, that misalignment occurs to the transfer sheet being conveyed to the image transfer section for transferring an image to the transfer sheet, and this misaligned transfer sheet is fed to the image transfer section. Then a misaligned image is transferred onto the transfer sheet. Thus, to prevent the image from being misaligned, transfer sheet must be fed to the image transfer section after correcting the misalignment of the transfer sheet.

In the image transfer section, arrival of the image (toner image) carried by the image carrier such as a photoreceptor drum and intermediate transfer belt must be timed with arrival of the transfer sheet conveyed by an automatic conveyance apparatus.

In one of the commonly known techniques to meet this requirement, a registration roller is provided on the upstream side of the image transfer section, and the leading edge of the transfer sheet is rotated by being brought in contact with the registration roller whose rotation has been stopped, whereby skewing of the transfer sheet is corrected. Further, to adjust the aforementioned timing in the conventional image forming apparatus, the aforementioned registration roller is used to control the time of arrival when the sheet is fed to the image transfer section. In one of the techniques using this control method (e.g. Patent Document 1), the position of the reference mark on the transfer sheet front surface and that on the image carrier are detected to estimate the amount of misalignment of the image marks on the front and rear surfaces in the sheet conveyance direction, thereby correcting the timing for feeding the transfer sheet on the registration roller. In another technique using this control method (e.g. Patent Document 2), immediately before a toner image on the rear surface is formed on the image carrier, the reference mark on the front surface of the transfer sheet is detected, whereby the timing for transfer is determined.

Further, in a conventional image forming apparatus, there is a further technique (e.g., Patent Documents 3 and 4) of adjusting the width-wise position of the transfer sheet perpendicular to the conveyance path wherein the reference mark of the transfer sheet front surface at some midpoint of a conveyance path is detected, and the timing of writing of the transfer sheet is corrected, whereby the position of the image in the main scanning direction and sub-scanning direction is corrected. In a still further technique (e.g., Patent Document 5), immediately before the toner image transferred to the rear surface of the transfer sheet is formed on the image carrier, the reference mark on the transfer sheet front surface is detected, thereby adjusting the position of the image formed on the image carrier in response to the position of the reference mark of the transfer sheet front surface at that time.

[Patent Document 1] Unexamined Japanese Patent Application Publication No. 2004-279749

[Patent Document 2] Unexamined Japanese Patent Application Publication No. 10-319674

[Patent Document 3] Unexamined Japanese Patent Application Publication No. 2000-305324

[Patent Document 4] Unexamined Japanese Patent Application Publication No. 2003-156974

[Patent Document 5] Unexamined Japanese Patent Application Publication No. 10-115954

However, while the transfer sheet is conveyed, transfer sheet misalignment may occur across the width of the transfer sheet perpendicular to the direction of conveyance (hereinafter referred to as "across the width"). Further, when an intermediate transfer belt is used as an image carrier, misalignment occurs to the image on the aforementioned intermediate transfer belt across the width due to coasting of the aforementioned intermediate transfer belt. Thus, when using a conventional device of adjusting the position across the width by reference mark position immediately before image formation on the conventional image carrier, it is necessary to increase the distance from detection of the reference mark to the transfer by the number of colors in the color printing mode. Accordingly, sheet and image carrier will be misaligned across the width due to conveyance and coasting during this time. This makes it difficult to make high-precision adjustment of the image position across the width. In the method of correction by adjusting the position in the direction of conveying a toner image formed on the image carrier and across the width without moving the transfer sheet per se, much time is required to correct the misalignment in the direction of conveyance of the image on the carrier for each page and misalignment across the width and to adjust the positions of the images on pages printed on a continuous basis.

SUMMARY OF THE INVENTION

The object of the present invention is to solve the aforementioned problems and to provide an image forming apparatus wherein, when forming an image on transfer sheet, the transfer sheet is shifted across the width immediately before transfer of the image onto transfer sheet based on the position of a toner image formed on an intermediate transfer member as an image carrier, and the misalignment across the width is adjusted, thereby ensuring high-speed and high-precision adjustment of the position of the image formed on a single side or both sides.

An image forming apparatus as an embodiment of the present invention for achieving the aforementioned object includes: a toner image forming section for forming a toner image; an intermediate transfer member on which the toner image is to be transferred; a transfer-marking section for transferring onto a front surface of a transfer sheet the toner image and a transfer sheet reference mark on said intermediate transfer member; an intermediate transfer member-marking section for forming an intermediate transfer member reference mark on said intermediate transfer member in a time period from transferring the toner image onto the front surface of the transfer sheet to completing a transfer of a toner image for a rear surface of the transfer sheet onto said intermediate transfer member; a transfer sheet reference mark detecting section for detecting a position of the transfer sheet reference mark formed on the front surface of the transfer sheet, in a width direction of the transfer sheet which is perpendicular to a direction of conveying the transfer sheet; an intermediate transfer member reference mark detecting section for detecting a position of the intermediate transfer member reference mark on said intermediate transfer member in the width direction; a calculation section for calculating an amount of position correction in the width direction based on the position of the transfer sheet reference mark and the position of the intermediate transfer member reference mark; and a position correction section for correcting a position of the transfer sheet in the width direction by shifting the transfer sheet in the width direction based on the amount of position correction.

An image forming apparatus as another embodiment of the present invention includes: a toner image forming section for forming a toner image; an intermediate transfer member on which the toner image is to be transferred; an intermediate transfer member-marking section for forming an intermediate transfer member reference mark on said intermediate transfer member before transferring the toner image onto the intermediate transfer member; a storage section for storing a position of the intermediate transfer member reference mark in a width direction of the transfer sheet which is perpendicular to a direction of conveying the transfer sheet of the intermediate transfer member reference mark; an intermediate transfer member reference mark detecting section for detecting a position of the intermediate transfer member reference mark transferred on said intermediate transfer member subsequent to transfer of the toner image onto said intermediate transfer member; a sheet edge position detecting section for detecting a position, in the width direction, of one side edge of the transfer sheet having been conveyed; a calculation section for calculating (a) an amount of misalignment of the transfer sheet in the width direction, based on information on a width of the transfer sheet in the width direction and the position of the one side edge of the transfer sheet; (b) an amount of misalignment of said intermediate transfer member in the width direction, based on the position of the intermediate transfer member reference mark stored in said storage section, and the position of the detected intermediate transfer member reference mark, and (c) an amount of position correction of the transfer sheet in the width direction, based on the amount of misalignment of the intermediate transfer member and the amount of misalignment of the transfer sheet; and a position correction section for correcting by shifting the transfer sheet in the width direction based on the amount of position correction of the transfer sheet in the width direction.

An image forming apparatus as still another embodiment of the present invention includes: a toner image forming section for forming a toner image; an intermediate transfer member on which the toner image is to be transferred; an intermediate transfer member-marking section for forming an intermediate transfer member reference mark on said intermediate transfer member before transferring the toner image onto the intermediate transfer member; a storage section for storing a position of the intermediate transfer member reference mark in a width direction of the transfer sheet which is perpendicular to a direction of conveying the transfer sheet of the intermediate transfer member reference mark; an intermediate transfer member reference mark detecting section for detecting a position of the intermediate transfer member reference mark transferred on said intermediate transfer member subsequent to transfer of the toner image onto said intermediate transfer member; a sheet edge position detecting section for detecting a position, in the width direction, of one side edge of the transfer sheet having been conveyed; a calculation section for calculating (a) an amount of misalignment of the transfer sheet in the width direction, based on information on a width of the transfer sheet in the width direction and the position of the one side edge of the transfer sheet; (b) an amount of misalignment of said intermediate transfer member in the width direction, based on the position of the intermediate transfer member reference mark stored in said storage section, and the position of the detected intermediate transfer member reference mark, and (c) an amount of position correction of a front surface of the transfer sheet in the width direction, based on the amount of misalignment of the intermediate transfer member and the amount of misalignment of a rear surface of the transfer sheet; a position correction section for correcting by shifting the transfer sheet in the width direction based on the amount of position correction of the front surface of the transfer sheet in the width direction; and a transfer-marking section for transferring onto the front surface of the transfer sheet the toner image and a transfer sheet reference mark on said intermediate transfer member, wherein said intermediate transfer member-marking section forms an intermediate transfer member reference mark on said intermediate transfer member in a time period from transferring the toner image onto the front surface of the transfer sheet to completing a transfer of a toner image for a rear surface of the transfer sheet onto said intermediate transfer member; said sheet edge position detecting section detects a position of the transfer sheet reference mark on the transfer sheet and a position of the transfer sheet in the width direction of the front surface of the transfer sheet having been reversed and conveyed; said intermediate transfer member reference mark detecting section detects a position, in the width direction, of the intermediate transfer member reference mark on the intermediate transfer member; said calculation section calculates an amount of position correction on the rear surface in the width direction, based on the position of the detected transfer sheet reference mark and the position of the intermediate transfer member reference mark; and said position correction section corrects by shifting the transfer sheet in the width direction, based on the amount of position correction on the rear surface of the transfer sheet.

DETAILED DESCRIPTION OF THE PREFERRED EMBODIMENTS

First Embodiment

Figure 1:
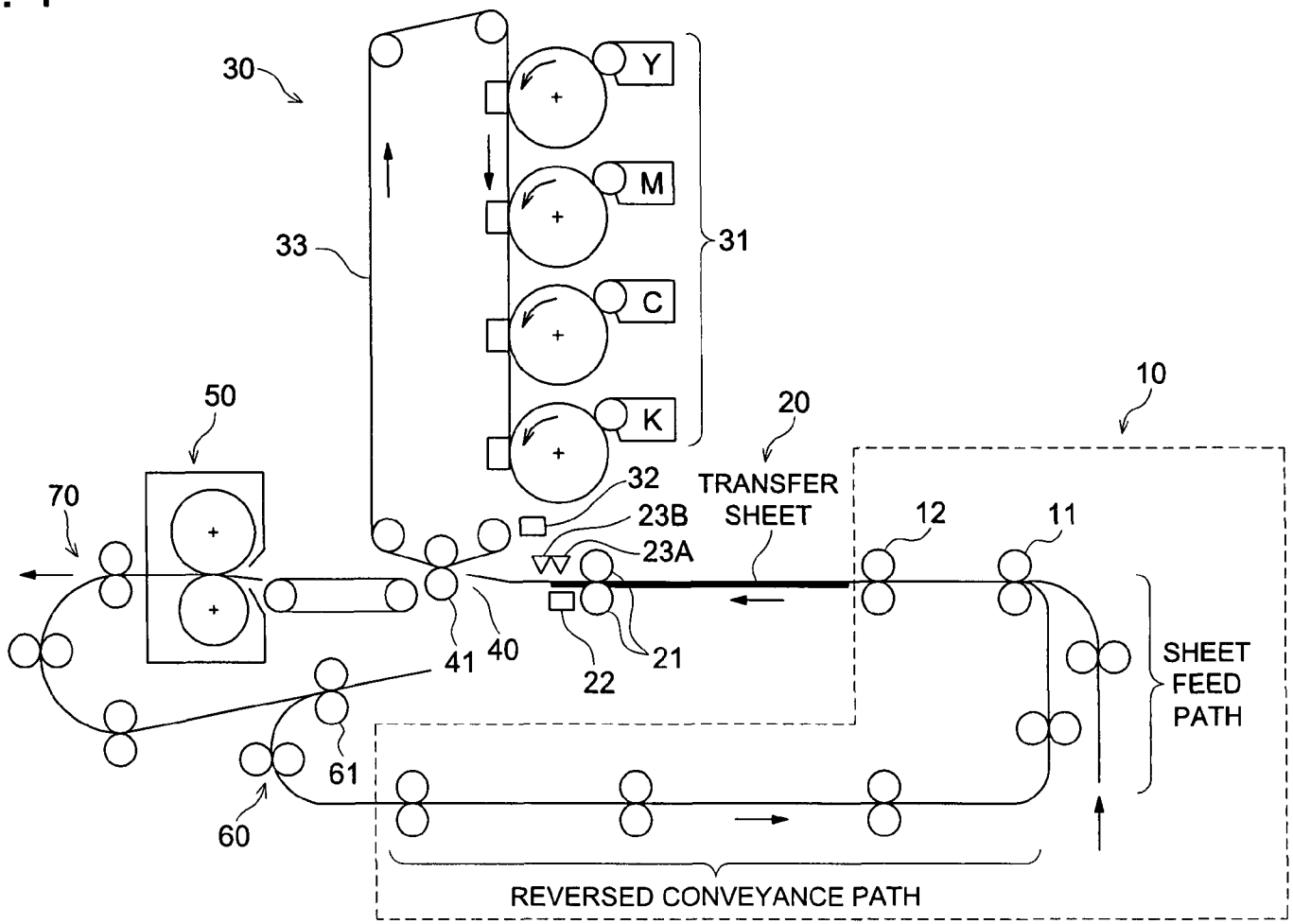
FIG. 1 is a schematic diagram schematically representing the conveyance path of an image forming apparatus as an embodiment of the present invention.
Figure 2:
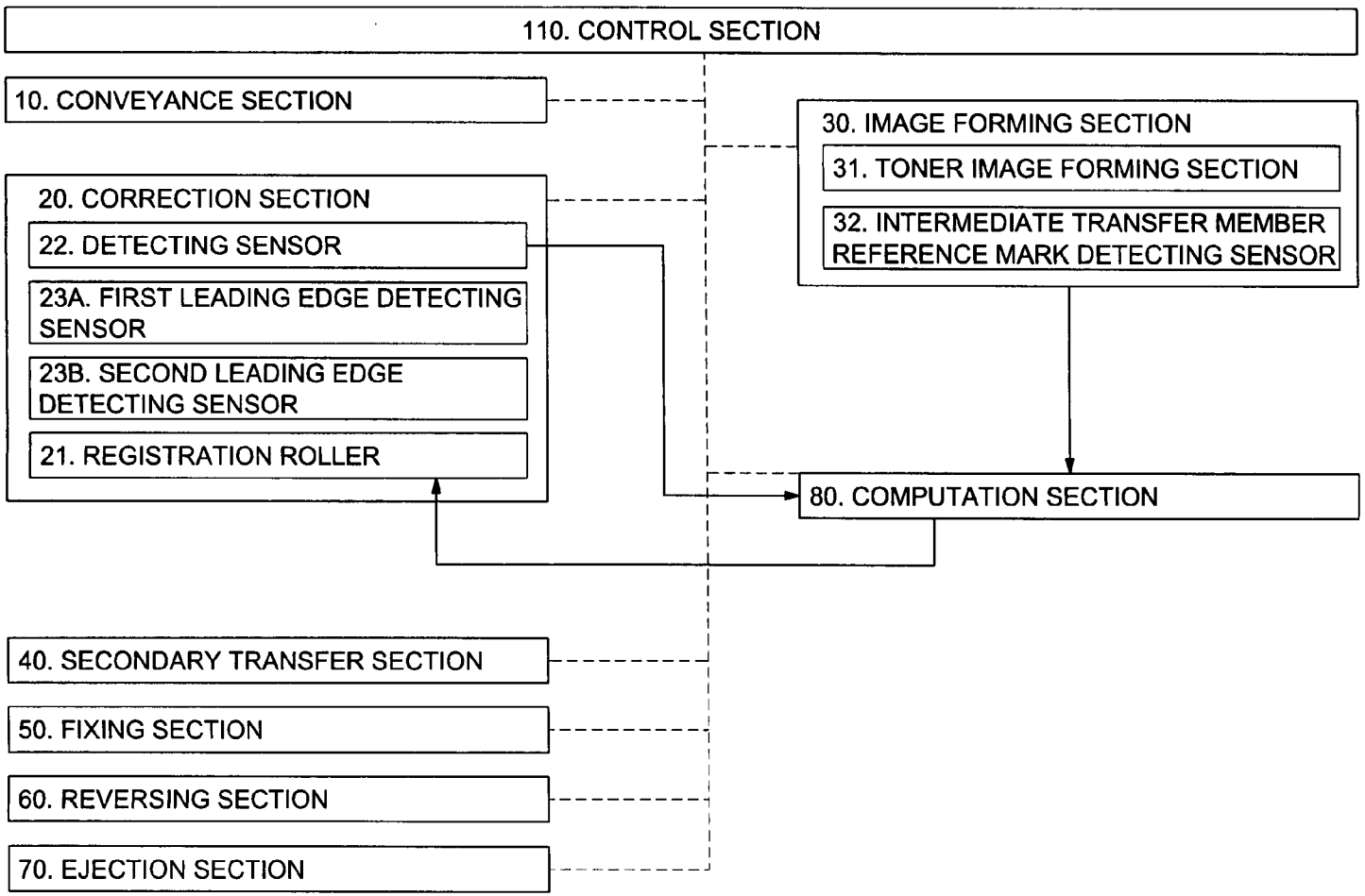
FIG. 2 is a block diagram representing the structure of the image forming apparatus as a first embodiment of the present invention.
Figure 3:
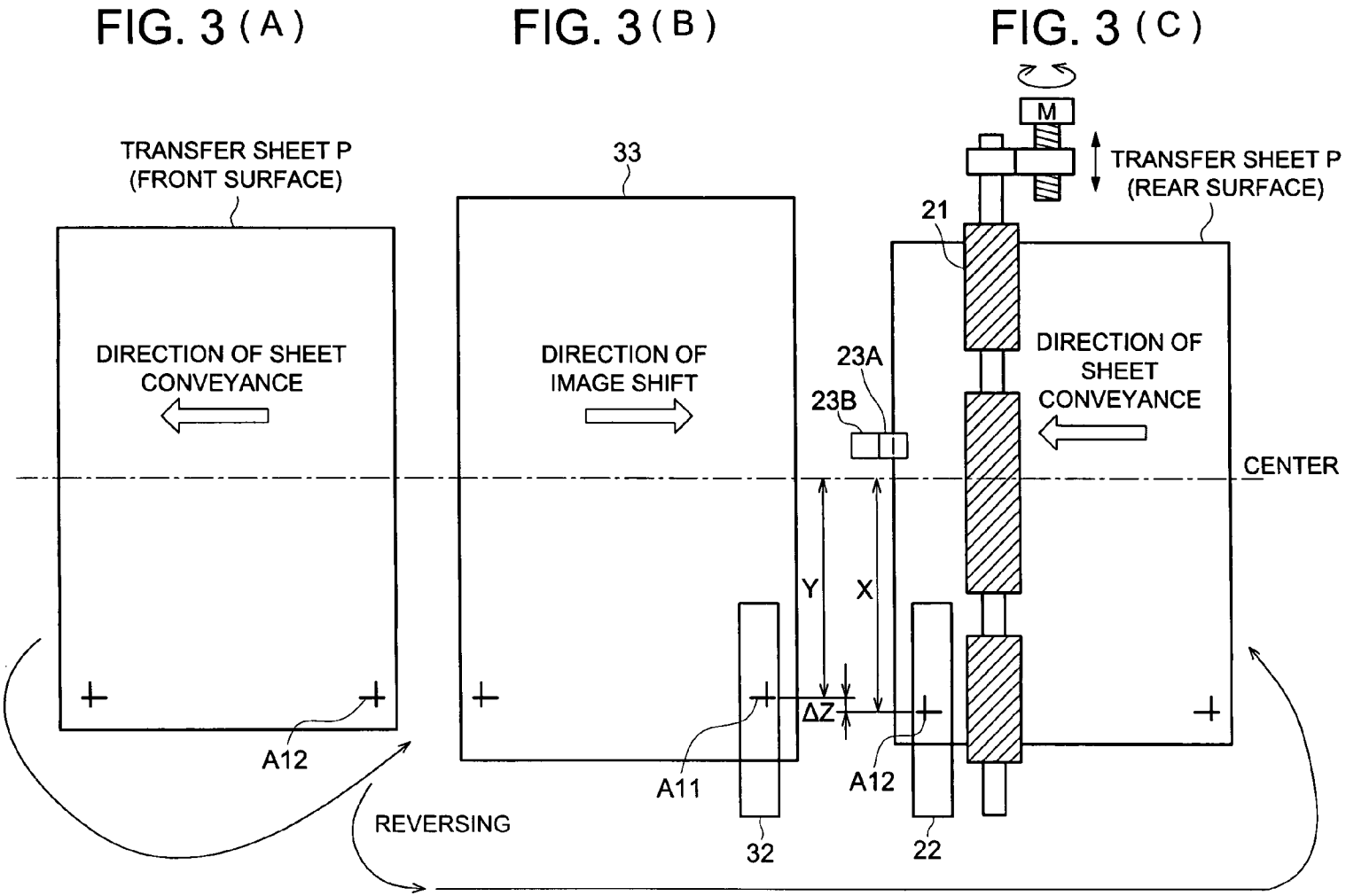
FIG. 3 is an explanatory diagram representing the position correction operation in the first embodiment of the present invention.
Figure 4:
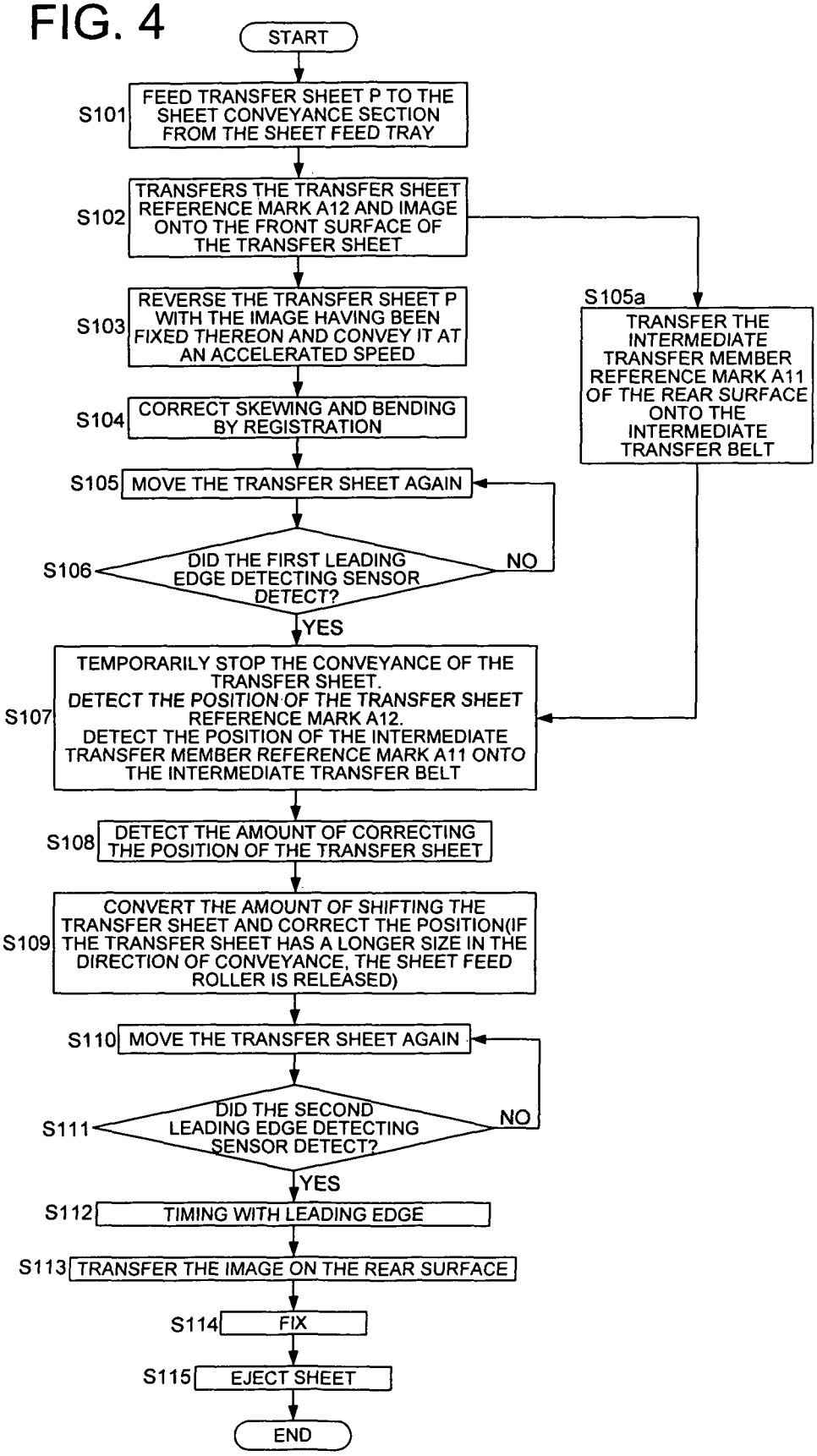
FIG. 4 is a flow chart showing the operation of the image information in the first embodiment of the present invention.

FIG. 1 is a schematic diagram schematically representing the conveyance path of an image forming apparatus as an embodiment of the present invention. FIG. 2 is a block diagram representing the structure of the image forming apparatus as a first embodiment of the present invention. FIG. 3 is a drawing representing the operation of the image forming apparatus as an embodiment of the present invention. FIG. 4 is a flow chart showing the control of correcting the position across the width of the transfer sheet in an embodiment of the present invention.

The image forming apparatus of the present embodiment contains a sheet conveyance section 10, correcting section 20, image forming section 30, secondary transfer section 40, fixing section 50, reversing section 60, and sheet ejection section 70, as shown in FIG. 1. These sections are placed under the control of a control section 110, as shown in FIG. 2. The solid line of FIG. 2 indicates the flow of information, while the dotted line denotes a control system. The following describes the structure of these sections in the present embodiment with reference to FIG. 1, FIG. 2 and FIG. 3. In the following description, each section is used as a subject in many cases. It should be understood that instructions and execution of the operations of these sections are placed under the effective management of the control section 110.

In FIG. 1, the sheet conveyance section 10 receives transfer sheet P from a sheet feed tray (not illustrated) and sends the transfer sheet P to a path formed by merging between a reversed conveyance path and the path (sheet feed path) from a sheet feed tray, through a loop roller 11. After that, using a sheet feed roller 12, the sheet conveyance section 10 sends the transfer sheet to the correcting section 20. Receiving the transfer sheet P from the reversing section 60, the sheet conveyance section 10 passes the transfer sheet through a reversed conveyance path and sends it to the path formed by merging between the sheet feed path and reversed conveyance path by a loop roller 11. Then the sheet conveyance section 10 again sends the transfer sheet P to the correcting section 20 by the sheet feed roller 12.

The correcting section 20 includes a registration roller 21, detecting sensor 22, first leading edge detecting sensor 23A and second leading edge detecting sensor 23B. These components and a secondary transfer roller 41 are arranged in that order according to the order in which the transfer sheet P is conveyed. The registration roller 21 is arranged perpendicular to the direction of conveyance. As shown in FIG. 3(C), the registration roller 21 sandwiches the transfer sheet P. It is made up of a pair of rollers that are capable of conveyance and arranged so as to cross the conveyance path. When the correcting section 20 has received the transfer sheet P from sheet conveyance section 10, it temporarily hits the side of the leading edge of the transfer sheet P against to the registration roller 21 so that the transfer sheet P is stopped once. This procedure allows a loop (deflection) to be formed on the transfer sheet P, and corrects the skewing and bending of the transfer sheet P in the direction of conveyance prior to correction across the width. This correction is carried out on both the front and rear surfaces of the transfer sheet P. The front surface of the transfer sheet P in the sense in which it is used here refers to one of the surfaces of the transfer sheet P wherein the image is transferred first, while the rear surface refers to the other surface of the transfer sheet P opposite to the surface wherein the image is transferred. Sandwiching the transfer sheet P, the registration roller 21 can be shifted along the sheet conveyance path across the width by a motor M. Having received the transfer sheet P with the rear surface facing upward (reversed), it shifts the transfer sheet P according to the correction instruction sent from the computation section 80, thereby performing correction of the transfer sheet P across the width. To be more specific, when the transfer sheet P is reversed, the leading edge of the transfer sheet P is fed out in the direction of conveyance by the registration roller 21, and arrival at a predetermined position on the leading edge of the transfer sheet P is detected by the first leading edge detecting sensor 23A. After arrival at a predetermined position, the conveyance of the transfer sheet P is stopped temporarily, and the position of the transfer sheet P is corrected by the registration roller 21.

The image forming section 30 includes a toner image forming section 31, intermediate transfer member reference mark detecting sensor 32, and intermediate transfer belt 33 as an intermediate transfer member. These components and secondary transfer roller 41 are arranged in the aforementioned order in the direction of rotation of the intermediate transfer belt 33. The toner image forming section 31 contains at least a photoreceptor, developing device and primary transfer section for primary transfer, as shown in FIG. 1. This primary transfer section is usually installed inside the intermediate transfer belt 33 and at the primary transfer position opposed to the photoreceptor. The toner image forming section 31 forms a toner image on the rotating intermediate transfer belt 33, wherein the toner image is to be transferred to the transfer sheet P. At the same time, the toner image forming section 31 generates an intermediate transfer member reference mark All at a predetermined position of the intermediate transfer belt 33, and feeds the transferred toner image to the secondary transfer section 40 using the intermediate transfer belt 33. In this case, if the intermediate transfer belt 33 conveys the rear surface image, the position of the intermediate transfer member reference mark All on the intermediate transfer belt 33 is detected by the intermediate transfer member reference mark detecting sensor 32. After that, the image is sent to the secondary transfer section 40. In this case, the toner image forming section 31 corresponds to "intermediate transfer member-marking section" and "toner image forming section" of the present invention. In this respect, in the present embodiment, one toner image forming section 31 performs the functions of both the "intermediate transfer member-marking section" and "toner image forming section", and is responsible for both generation of the intermediate transfer member reference mark All and formation of a toner image. However, these functions can be shared by two devices, and the "intermediate transfer member-marking section" can be arranged before the "toner image forming section".

The secondary transfer section 40 performs a secondary transfer; it uses the secondary transfer roller 41 to transfer the toner image having been carried by the intermediate transfer belt 33, and this toner image is transferred to the transfer sheet P having been fed from the correcting section 20. In this case, the secondary transfer section 40 transfers the intermediate transfer member reference mark All to the transfer sheet P having been conveyed with the front surface facing upward, so that the transfer sheet reference mark A12 is formed on the front surface of the transfer sheet P. After that, the secondary transfer section 40 sends the transfer sheet P to the fixing section 50. The secondary transfer section 40 transfers only the image when the transfer sheet P with the rear surface facing upward has been conveyed, and the transfer sheet P is fed to the fixing section 50. In this case, the secondary transfer section 40 corresponds to the "transfer-marking section" of the present invention.

Having fixed the image formed on the transfer sheet P received from the secondary transfer section 40, fixing section 50 sends it to the ejection section 70.

The sheet ejection section 70 receives the transfer sheet P from the fixing section 50. If image formation on the rear surface is required, the sheet ejection section 70 sends it to the reversing section 60. If image formation on the rear surface is not required, the sheet ejection section 70 ejects the transfer sheet P.

The reversing section 60 uses the reversing roller 61 to reverse the transfer sheet P received from the sheet ejection section 70. Then, it sends the sheet to the reversed conveyance path of the sheet conveyance section 10. The reversing section 60 mainly includes a reversing roller 61 and back-and-forth conveyance path. Having received from the fixing section 50 the transfer sheet P with an image formed on the front surface, the reversing section 60 reverses the reversing roller 61, sends the sheet to the reversed conveyance path. The transfer sheet P having been reversed at this time is sent to the registration roller 21 with the rear surface facing upward.

A shown in FIG. 3(C), the detecting sensor 22 has a length-wise direction in the width-wise direction perpendicular to the direction of conveying the transfer sheet. Optical sensors are arranged in the length-wise direction, and the distance from the predetermined position (e.g., center of FIG. 3(C)) to each sensor is stored therein. If any one of the sensors has detected the transfer sheet reference mark A12, position X is identified as the distance from the predetermined position of the detecting sensor 22, based on the position of the sensor having detected. In this case, the detecting sensor 22 corresponds to the "transfer sheet reference mark detecting section" of the present invention.

As shown in FIG. 3(B), the intermediate transfer member reference mark detecting sensor 32 has a length-wise direction in the width-wise direction perpendicular to the direction of conveying the transfer sheet. Optical sensors are arranged in the length-wise direction, and the distance from the predetermined position (e.g., center of FIG. 3(B)) to each sensor is stored therein. If any one of the sensors has detected the intermediate transfer member reference mark A11, position Y is identified as the distance from the predetermined position of the intermediate transfer member reference mark detecting sensor 32, based on the position of the sensor having detected.

Thus, the detecting sensor 22 and intermediate transfer member reference mark detecting sensor 32 are preferably mounted close to the transfer section 40. To be more specific, based on the positions detected by the detecting sensor 22 and intermediate transfer member reference mark detecting sensor 32, the position of the transfer sheet P across the width is corrected, and therefore, the distance and time from detection to actual transfer are preferably as short as possible.

In response to the positions detected by the detecting sensor 22 and intermediate transfer member reference mark detecting sensor 32, the computation section 80 obtains the amount of correction in the following procedure and sends the result to the correcting section 20.

Details of Correction Across the Width

The following describes the details of the procedures of correcting the position of the transfer sheet P across the width using a registration roller 21: In FIG. 3, (A) indicates the front surface of the transfer sheet P to which the image and transfer sheet reference mark A12 have already been transferred. (B) shows the intermediate transfer belt 33 to which the rear surface is to be transferred to the transfer sheet P. (C) represents the rear surface of the transfer sheet P to which the rear surface is to be transferred by the secondary transfer section 40 after the transfer sheet P of (A) with the image transferred to the front surface thereof is reversed by the reversing section 60 and is sent to the correcting section 20 by the sheet conveyance section 10. The process of position correction is applied to the rear surface of the transfer sheet P of FIG. 3 (C). Further, the image forming apparatus in the present embodiment stores the position of the center as the centerline across the width in the conveyance path (the centerline in the sense in which it is used here refers to the result of calculation containing mechanical errors) as a reference position. The position of the reference mark in the present embodiment refers to the distance from the center to the reference mark.

As described above, the detecting sensor 22 detects the position X of the transfer sheet reference mark A12 on the front surface of the transfer sheet P in FIG. 3. Then the toner image forming section 31 transfers the intermediate transfer member reference mark A11 onto the intermediate transfer belt 33. The intermediate transfer belt 33 is fed toward the secondary transfer section 40. The intermediate transfer member reference mark detecting sensor 32 detects the position Y of the intermediate transfer member reference mark A11 which is transferred onto the intermediate transfer belt 33 of FIG. 3. Then, based on the position X of the transfer sheet reference mark A12 and the position Y of the intermediate transfer member reference mark A11, the computation section 80 calculates the amount of correcting the position across the width of the transfer sheet $P\Delta Z=X-Y$. The position of the intermediate transfer member reference mark A11 and transfer sheet reference mark A12 calculated in the present embodiment is the distance from the center to the edge on one side of the transfer sheet P. It is also possible to set the reference position at the top end of the conveyance path or a point other than the center.

Based on this correction amount $\Delta Z$, motor M is operated and the registration roller 21 is moved across the width, whereby the transfer sheet P is shifted to correct the position of the transfer sheet P across the width. In this case, if the transfer sheet P has a longer side in the direction of conveyance, the sheet feed roller 12 is released. This will permit the position to be corrected.

The temporary stop of the conveyance of the transfer sheet P is released and the transfer sheet P is fed out again in the direction of conveyance by the registration roller 21. The second leading edge detecting sensor 23B checks if the leading edge of the transfer sheet P has reached the predetermined position or not. In this case, since the transfer sheet P has been conveyed at an accelerated speed so far, it is fed faster than the intermediate transfer belt 33 carrying the toner image. Thus, to ensure that the position where the image of the transfer sheet P is transferred is adjusted to the position of the toner image in the direction of conveyance on the intermediate transfer belt 33, the conveyance speed must be adjusted. The registration roller 21 adjusts the time of feeding by delaying the conveyance speed of the transfer sheet P, and feeds out the transfer sheet P to the secondary transfer section 40, thereby adjusting the transfer position in the direction of conveyance with respect to the toner image on the intermediate transfer belt 33.

The registration roller 21 corresponds to the "position correction section" of the present invention and the detecting sensor 22 corresponds to the "transfer sheet reference mark detecting section" of the present invention.

In this case, the best form for the image formation on the front and rear surfaces is assumed in the present embodiment, and a loop is formed by a registration roller 21 to correct the skewing and bending. For this method of correction, it is also possible to adopt other methods such as correction of the position in the direction of conveyance of the intermediate transfer belt 33, when a toner image is formed on the intermediate transfer belt 33. Alternatively, it is also possible to adopt the arrangement where no correction is made.

The following describes the image formation flow in the present embodiment with reference to FIG. 1 and FIG. 4.

Step S101: Transfer sheet P is fed to the sheet conveyance section 10, and is fed out in the direction of conveyance by the loop roller 11 and sheet feed roller 12.

Step S102: After the registration roller 21 has corrected the skewing and bending, the secondary transfer section 40 transfers the image and intermediate transfer member reference mark All onto the front surface of the transfer sheet P.

Step S103: The transfer sheet P with the image having been fixed thereon is reversed by the reversing section 60, and is conveyed at an accelerated speed.

Step S104: The transfer sheet P is fed through the sheet conveyance section 10, and is made to hit the registration roller 21 by the loop roller 11 and sheet feed roller 12, whereby skewing and bending of the transfer sheet P are corrected.

Step S105 and Step S106: The transfer sheet P is fed out in the direction of conveyance by the registration roller 21 until the first leading edge detecting sensor 23A detects the leading edge of the transfer sheet P.

Step S105*a:* Subsequent to image formation on the front surface, the intermediate transfer belt 33 rotates. Then, the toner image to be formed on the rear surface and the intermediate transfer member reference mark All are transferred onto the intermediate transfer belt 33 by the toner image forming section 31.

Step S107: In response to the first leading edge detecting sensor 23A having detected the leading edge of the transfer sheet P, the registration roller 21 temporarily stops the conveyance of the transfer sheet P. The detecting sensor 22 detects the position X of the transfer sheet reference mark A12 of the transfer sheet P. Further, the intermediate transfer belt 33 is fed toward the secondary transfer roller 41, and the intermediate transfer member reference mark detecting sensor 32 detects the position Y of the intermediate transfer member reference mark A11 transferred onto the intermediate transfer belt 33.

Step S108: The amount ΔZ of correcting the position of the transfer sheet P across the width is calculated based on each of positions Y and X of the intermediate transfer member reference mark A11 and transfer sheet reference mark A12 detected by the computation section 80.

Step S109: The registration roller 21 shifts the transfer sheet P by the amount of correction amount ΔZ and corrects the position of the transfer sheet P across the width. In this case, if the transfer sheet P has a longer size in the direction of conveyance, the sheet feed roller 12 is released, whereby the position can be corrected.

Step S110 and Step S111: The registration roller 21 releases the stop of the transfer sheet P, and feeds out the transfer sheet P in the direction of conveyance until second leading edge detecting sensor 23B detects the leading edge of the transfer sheet P.

Step S112: Synchronously with the leading edge, the registration roller 21 feeds out the transfer sheet P toward the secondary transfer section 40.

Step S113: The transfer section 40 transfers the image onto the transfer sheet P.

Step S114: The fixing section 50 fixes the image in position.

Step S115: The sheet ejection section 70 ejects the transfer sheet P to terminate the process of image formation.

In the image forming apparatus of the present embodiment, the amount of correcting the position of the transfer sheet P across the width is calculated immediately before transfer, and correction is performed. This arrangement eliminates the possibility of an image misalignment occurring on the front and rear surfaces, and ensures high-precision adjustment of the position of the image on the rear surface when an image is formed on the rear surface.

Second Embodiment

The first embodiment is intended to provide correction across the width when an image is transferred onto the rear surface of the transfer sheet P. The second embodiment provides correction across the width when an image is transferred onto both the front and rear surfaces of the transfer sheet P.

Figure 5:
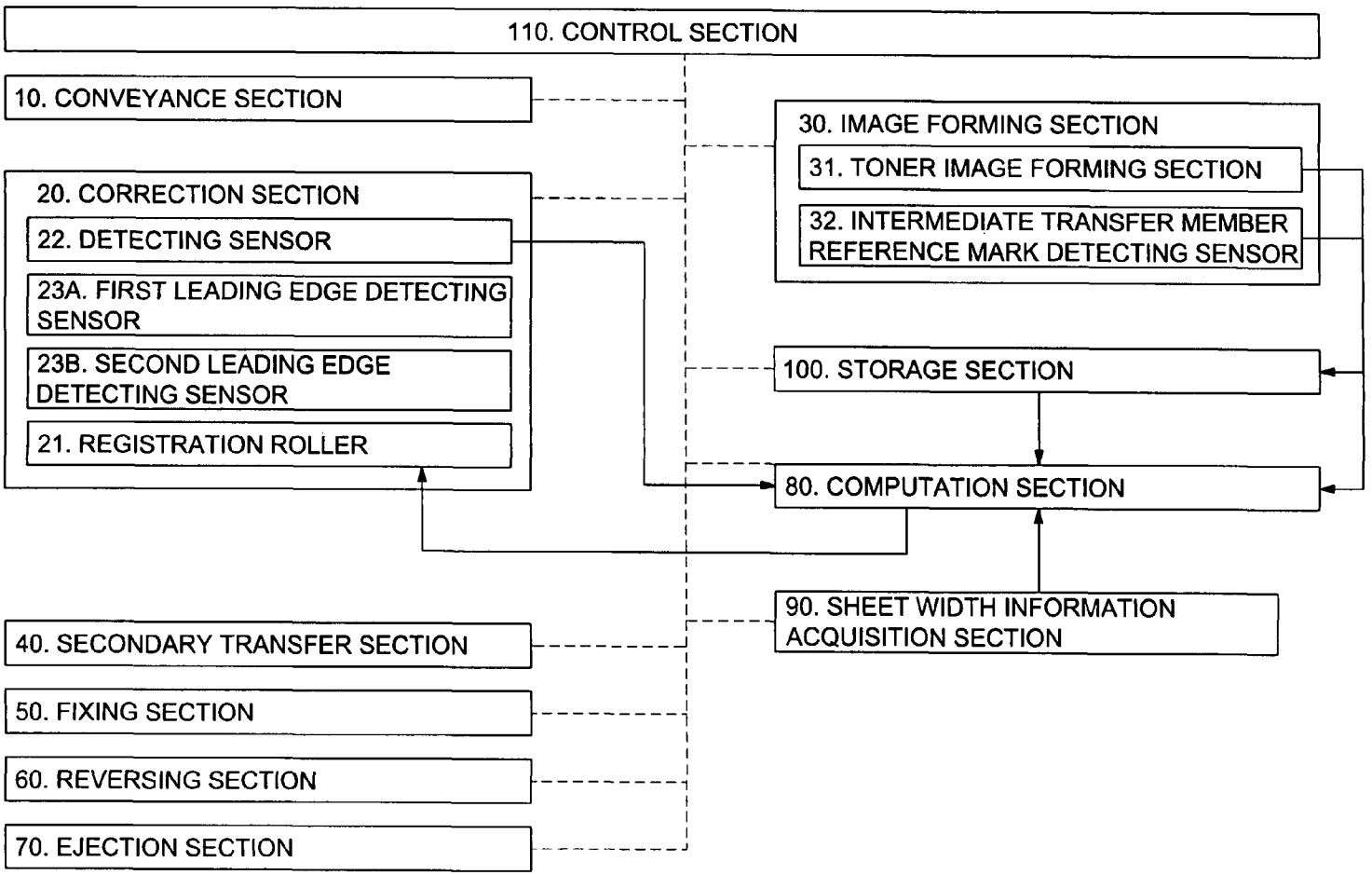
FIG. 5 is a block diagram showing the structure of the image forming apparatus as a second embodiment of the present invention.

The structure of the image forming apparatus as the second embodiment is almost the same as that of the first embodiment. In the first embodiment, the transfer sheet reference mark A12 is used to check the position of the transfer sheet P across the width; whereas in the second embodiment, the detecting sensor 22 detects the position of the edge on one side of the transfer sheet P with respect to the center as the reference position. This detecting sensor 22 corresponds to the "sheet edge position detecting section" of this invention. As shown in FIG. 5, the further difference from the first embodiment is that the second embodiment includes the sheet width information acquisition section 90 for getting information on the length of transfer sheet P across the width, and a storage section 100 for storing the position of the intermediate transfer member reference mark A22 transferred onto the intermediate transfer belt 33 by the toner image forming section 31. In this case, information on the sheet width to be obtained by the sheet width information acquisition section 90 can be inputted by the operator. Alternatively, the information on the sheet width detected by the sheet feed tray can be sent.

Figure 6:
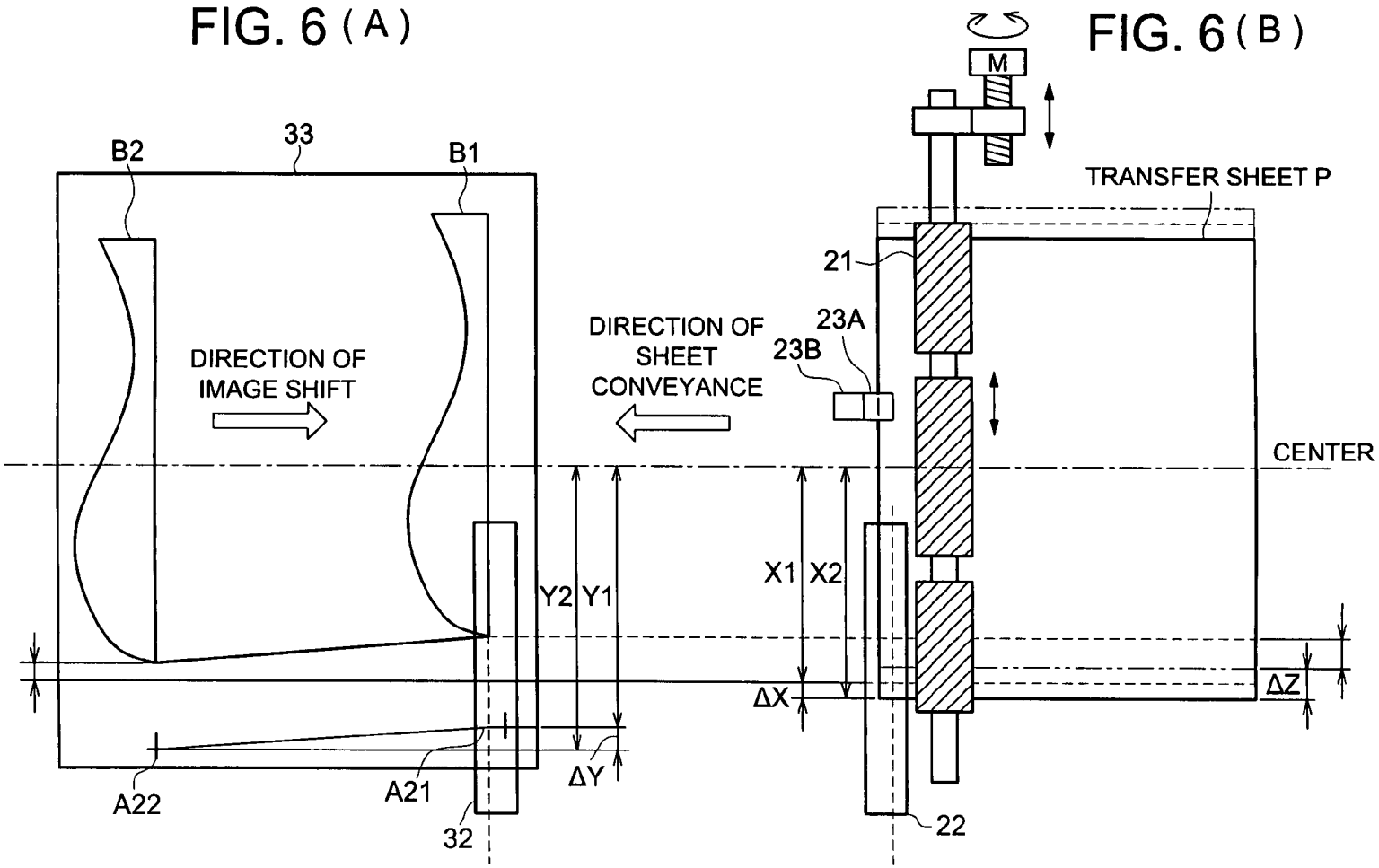
FIG. 6 is an explanatory diagram representing the position correction operation in the second embodiment of the present invention.

The structure of the correcting section 20 and image forming section 30 of the present Example will be explained with reference to FIG. 1, FIG. 5 and FIG. 6. In FIG. 5, the same reference numerals as those of FIG. 1 and FIG. 2 have the same function unless otherwise specified.

The correcting section 20 ensures that the transfer sheet P received from the sheet conveyance section 10 hits the registration roller 21 to form a loop, whereby skewing and bending are corrected. Further, in the correcting section 20, the registration roller 21 feeds out the transfer sheet P in the direction of conveyance, and the first leading edge detecting sensor 23A detects the arrival of the leading edge of the transfer sheet P to a predetermined position. After arrival to the predetermined position, the conveyance of the transfer sheet P is temporarily stopped and the position X2 of the edge on one side of the transfer sheet P is detected by the detecting sensor 22 (FIG. 6(B)). Then, the position of the transfer sheet P across the width is corrected by the registration roller 21.

The image forming section 30 ensures that the toner image and intermediate transfer member reference mark A22 to be transferred to the transfer sheet P is primarily sent from the toner image forming section 31 to the intermediate transfer belt 33. The transferred toner image is sent by the intermediate transfer belt 33. After that, the position Y1 of the intermediate transfer member reference mark A21 on the intermediate transfer belt 33 is detected by the intermediate transfer member reference mark detecting sensor 32 (FIG. 6 (A)). The toner image is then sent to the secondary transfer section 40.

Details of Correction Across the Width

The following describes the details of procedure of correcting the position across the width of the transfer sheet P by the registration roller 21 for stopping the conveyance of the transfer sheet P, as described above. In FIG. 6,(A) represents the intermediate transfer belt 33 to transfer the front surface of the transfer sheet P, and (B) denotes the transfer sheet P which has been sent by the sheet conveyance section 10 and whose front surface is to be transferred. Further, similarly to the case of the first embodiment, the image forming apparatus in the present embodiment stores as the reference position the position of the center as the centerline across the width in the conveyance path. The position of the reference mark of the present embodiment and that of the edge on one side refer to the distance from the center to the reference mark or the edge on one side of the transfer sheet P.

In the first place, the amount of misalignment of the transfer sheet P is calculated. The following specifically describes the procedure of calculating the misalignment of the transfer sheet P. The detecting sensor 22 detects the position X2 of the edge on one side of the transfer sheet P in FIG. 6. Then, the computation section 80 calculates the standard position of the edge on one side of the sheet from the length of the transfer sheet P across the width acquired by the sheet width information acquisition. In the present embodiment, the standard transfer sheet P is located where the center is aligned with the centerline of the transfer sheet P across the width. Thus, X1 has a length equivalent to half the width of the transfer sheet P. Then the amount of misalignment of the transfer sheet P$\Delta X = X2 - X1$ is calculated from the detected position X2 of the edge on one side of the sheet and the standard position X1 of the edge on one side. The position of the edge on one side of the sheet calculated in the present embodiment is assumed as a distance from the center as the centerline of the conveyance path to the edge on one side of the transfer sheet P. However, the reference can be set to other than the center.

In the meantime, the amount of misalignment of the intermediate transfer belt 33 is calculated. The following specifically describes the procedure of calculating the misalignment of the intermediate transfer belt 33. In the first place, the intermediate transfer member reference mark A21 of FIG. 6 is an intermediate transfer member reference mark immediately before position correction, B1 is the position of the toner image at that time, the intermediate transfer member reference mark A22 is the initially transferred intermediate transfer member reference mark and B2 is the position of the toner image. The intermediate transfer member reference mark A21 and intermediate transfer member reference mark A22 are the same intermediate transfer member reference marks. B1 and B2 belong to the same toner image. In the interval between the transfer of the intermediate transfer member reference mark A22 onto the intermediate transfer belt 33 and the detection thereof, misalignment occurs to the intermediate transfer member reference mark A21 due to coasting of the intermediate transfer belt 33, accordingly, to the toner image B1 resulting from the toner image B2. The toner image forming section 31 transfers the intermediate transfer member reference mark A22 onto the intermediate transfer belt 33. The position Y2 of the transferred intermediate transfer member reference mark A22 (an ideal transfer position prior to coasting of the intermediate transfer member reference mark A22) is stored in the storage section 100. Then, the intermediate transfer belt 33 is fed to the transfer section 40. After rotation of the intermediate transfer belt 33 from the position of transfer of the intermediate transfer member reference mark A22 to the position of the intermediate transfer member reference mark detecting sensor 32, the intermediate transfer member reference mark detecting sensor 32 detects the position Y1 (position after coasting of the intermediate transfer member reference mark A22) of the intermediate transfer member reference mark A21 having transferred onto the intermediate transfer belt 33. From the stored position Y2 of the intermediate transfer member reference mark A22 and detected position Y1 of the intermediate transfer member reference mark A21, the computation section 80 calculates the amount of misalignment of the intermediate transfer belt 33 $\Delta Y = Y2 - Y1$. The reference mark position detected in the present embodiment is assumed as the distance from the center to the reference mark, but the reference for calculation can be set to other than the center.

From the amount of misalignment of the transfer sheet P $\Delta X$ and the amount of misalignment of the intermediate transfer belt 33 $\Delta Y$, the computation section 80 calculates the amount of correcting the position of the transfer sheet P across the width $\Delta Z = \Delta X + \Delta Y$.

Based on the aforementioned amount of correction amount $\Delta Z$, the motor M is operated and the registration roller 21 is moved across the width, whereby the transfer sheet P is shifted so that the position of the transfer sheet P across the width is corrected. In this case, when the transfer sheet P is longer in the direction of conveyance, the sheet feed roller 12 is released. This permits the position to be corrected.

After the aforementioned correction, the correcting section 20 releases the temporary stop of the conveyance of the transfer sheet P and feeds the transfer sheet P again in the direction of conveyance by the registration roller 21. The second leading edge detecting sensor 23B detects the arrival of the leading edge of the transfer sheet P to a predetermined position. After the arrival, the time of feeding out is adjusted by the registration roller 21, and the transfer sheet P is fed out to the secondary transfer section 40.

In the present embodiment, images are formed on both the front and rear surfaces of the transfer sheet P. It is also possible to make such arrangements that an image is formed only on one side, i.e., on the front surface. In this case, there is no need of using the reversing section 60 of FIG. 1. Thus, image formation is terminated without determining if the rear surface requires printing or not. When images are formed on both surfaces, the aforementioned correction steps are taken twice—on the front and rear surfaces.

Figure 7:
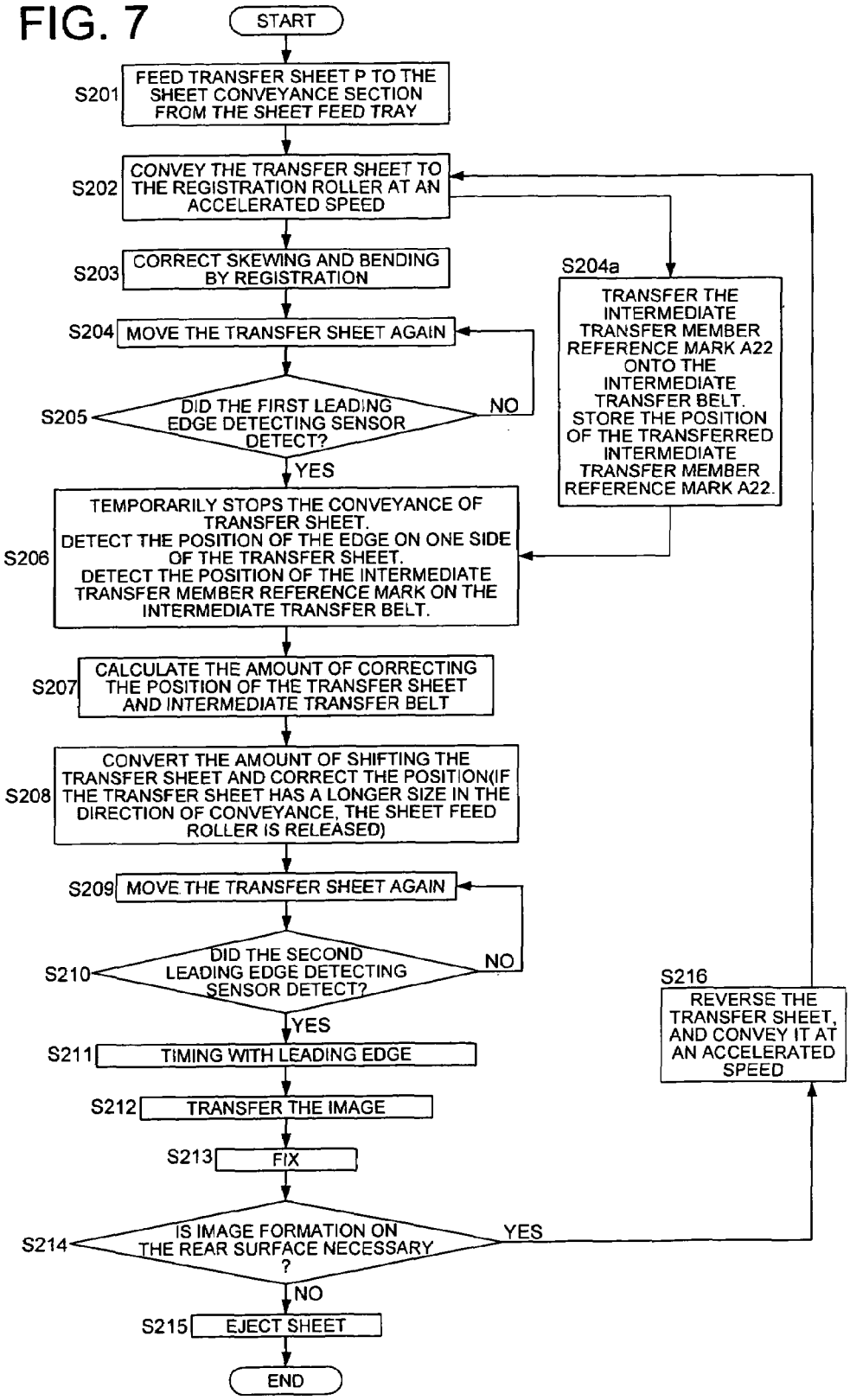
FIG. 7 is a flow chart representing the image formation operation in the second embodiment of the present invention.

The following describes the image formation flow the present embodiment with reference to FIG. 1 and FIG. 7:

Step S201: Transfer sheet P is fed from the sheet feed tray to the sheet conveyance section 10.

Step S202: The transfer sheet P is fed out by the loop roller 11 and sheet feed roller 12 until it hits the registration roller 21.

Step S203: A loop is formed by the registration roller 21, whereby skewing and bending of the transfer sheet P are corrected.

Step S204 and Step S205: Transfer sheet P is again fed in the direction of conveyance by the registration roller 21 until the first leading edge detecting sensor 23A detects the leading edge of transfer sheet P.

Step S204*a:* The toner image forming section 31 transfers the intermediate transfer member reference mark A22 onto the intermediate transfer belt 33, and the storage section 100 stores the position Y2 of the transferred intermediate transfer member reference mark A22 (an ideal transfer position prior to coasting of the intermediate transfer member reference mark A22).

Step S206: When the first leading edge detecting sensor 23A has detected the leading edge of transfer sheet P, the registration roller 21 temporarily stops the conveyance of transfer sheet P, and the detecting sensor 22 detects the position X2 of the edge on one side of the transfer sheet P. In the meantime, the intermediate transfer belt 33 is fed in the direction of the secondary transfer roller 41, and the intermediate transfer member reference mark detecting sensor 32 detects the position Y1 of the intermediate transfer member reference mark A21 transferred onto the intermediate transfer belt 33 (position subsequent to coasting of the intermediate transfer member reference mark A22).

Step S207: From the information on the width of the transfer sheet P acquired by the sheet width information acquisition section 90, the computation section 80 calculates the standard position of the edge on one side. It also calculates the amount ΔZ of correcting the position of the transfer sheet P, based on the detected position X2 of the edge on one side of the sheet, the standard position X1 of the edge on one side, the stored position Y2 of the intermediate transfer member reference mark A22 on the intermediate transfer belt, and the stored position Y1 of the intermediate transfer member reference mark A21 on the intermediate transfer belt 33.

Step S208: The registration roller 21 shifts the transfer sheet P by the amount of correction ΔZ, and corrects the position of the transfer sheet P across the width. In this case, if transfer sheet P is longer in the direction of conveyance, the sheet feed roller 12 is released. This permits the position to be corrected.

Step S209 and Step S210: The stop of the transfer sheet P is released, and the transfer sheet P is again fed in the direction of conveyance by the registration roller 21 until the second leading edge detecting sensor 23B detects the leading edge of transfer sheet P.

Step S211: The registration roller 21 feeds out the transfer sheet P toward the secondary transfer roller 41 in exact timing with the leading edge.

Step S212: The transfer section 40 transfers an image on transfer sheet P.

Step S213: The fixing section 50 fixes the image in position.

Step S214: A decision step is taken to determine if an image should be formed on the rear surface or not.

Step S215: If it has been determined in Step S214 that formation of an image on the rear surface is not necessary, the sheet ejection section 70 ejects the transfer sheet P and the process of image formation terminates.

Step S216: If it has been determined in Step S214 that formation of an image on the rear surface is necessary, the reversing section 60 reverses the transfer sheet P and the transfer sheet P is fed again to the sheet feed roller 12 through the loop roller 11 along the reversed conveyance path of the sheet conveyance section 10. Then, the procedures from Step S202 to Step S214 are repeated.

In the image forming apparatus of this embodiment, the position of the transfer sheet P across the width is corrected, whereby the image is always kept within a predetermined distance from the sheet edge. This arrangement ensures high-precision adjustment of the position of the images among different pages.

Third Embodiment

The structure of the image forming apparatus as a third embodiment is basically the same as that of the first and second embodiments. The difference is that the detecting sensor 22 of the third embodiment performs the functions of detecting both the sheet edge position and the transfer sheet reference mark on transfer sheet, and the third embodiment is provided with a detecting section that detects the position of the edge on one side of the transfer sheet only when the transfer sheet reference mark A12 on the transfer sheet is not detected.

Figure 8:
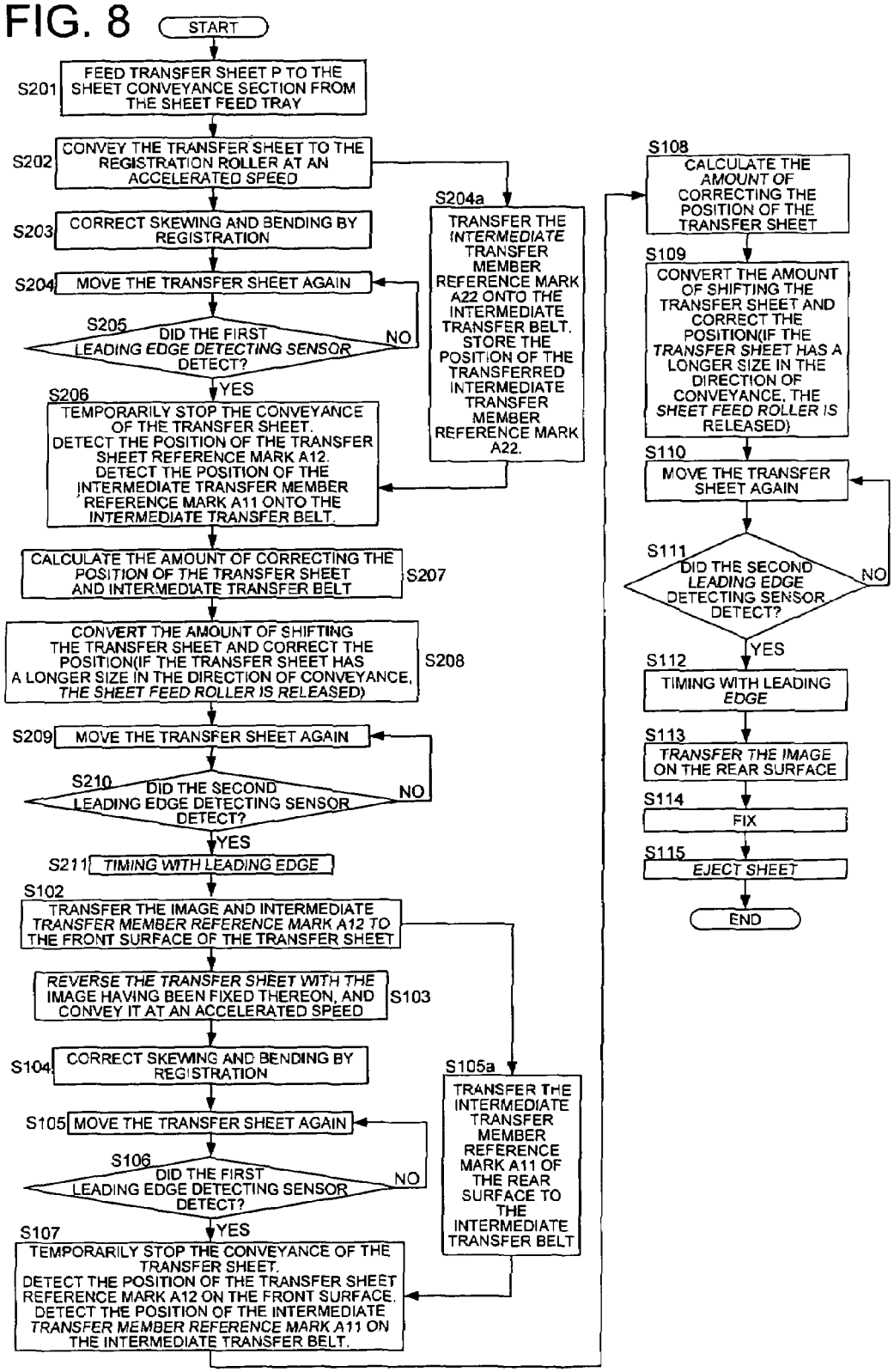
FIG. 8 is a flow chart representing the image formation operation in the third embodiment of the present invention.

The following describes the image formation flow of the present embodiment with reference to FIG. 8. Here, the S-number refers to the step number of FIG. 4 and FIG. 7.

(1) Transfer sheet P is fed from the sheet feed tray to the sheet conveyance section 10 (S201).

(2) Transfer sheet P is fed out by the loop roller 11 and sheet feed roller 12 until it hits the registration roller 21 (S202).

(3) The registration roller 21 forms a loop to correct the skewing and bending of the transfer sheet P (S203).

(4) The registration roller 21 again feeds out the transfer sheet P in the direction of conveyance until the first leading edge detecting sensor 23A detects the leading edge of the transfer sheet (S204 and S205).

(5) The toner image forming section 31 transfers the intermediate transfer member reference mark A22 onto the intermediate transfer belt 33, and the storage section 100 stores the position Y2 of the transferred intermediate transfer member reference mark A22 (an ideal transfer position prior to coasting of the intermediate transfer member reference mark A22) (S204*a*).

(6) Since the transfer sheet reference mark A12 on the front surface is not yet transferred to the transfer sheet P, the detecting sensor 22, without defecting the transfer sheet reference mark A12, goes to the process of correcting the position of the sheet edge on one side, similarly to the case of the second embodiment.

(7) When the first leading edge detecting sensor 23A has detected the leading edge of the transfer sheet P, the registration roller 21 temporarily stops the conveyance of the transfer sheet P, and the detecting sensor 22 detects the position X2 of the edge on one side of the transfer sheet P. In the meantime, the intermediate transfer belt 33 is fed toward the secondary transfer roller 41, and the intermediate transfer member reference mark detecting sensor 32 detects the position Y1 of the intermediate transfer member reference mark A21 transferred onto the intermediate transfer belt 33 (position subsequent to coasting of the intermediate transfer member reference mark A22) (S206).

(8) From the information on the width of the transfer sheet P acquired by the sheet width information acquisition section 90, the computation section 80 calculates the standard position X1 of the edge on one side of the sheet. It also calculates the amount ΔZ of correcting the position of the transfer sheet P, based on the detected position X2 of the edge on one side of the sheet, the standard position of the edge on one side, the stored position Y2 of the intermediate transfer member reference mark A22 on the intermediate transfer belt, and the stored position Y1 of the intermediate transfer member reference mark A21 on the intermediate transfer belt 33 (S207).

(9) The registration roller 21 shifts the transfer sheet P by the amount of correction ΔZ, and corrects the position of the transfer sheet P across the width. In this case, if transfer sheet P is longer in the direction of conveyance, the sheet feed roller 12 is released. This permits the position to be corrected (S208).

(10) The stop of the transfer sheet P is released, and the transfer sheet P is again fed in the direction of conveyance by the registration roller 21 until the second leading edge detecting sensor 23B detects the leading edge of transfer sheet P (S209 and S210).

(11) The registration roller 21 feeds out the transfer sheet P toward the secondary transfer roller 41 in exact timing with the leading edge (S211).

(12) After the registration roller 21 has corrected the skewing and bending, the secondary transfer section 40 transfers the image and transfer member reference mark A12 onto the front surface of the transfer sheet P (S102).

(13) The transfer sheet P with the image having been fixed thereon is reversed by the reversing section 60, and is conveyed at an accelerated speed (S103).

(14) The transfer sheet P is fed through the sheet conveyance section 10, and is made to hit the registration roller 21 by the loop roller 11 and sheet feed roller 12, whereby skewing and bending of the transfer sheet P are corrected (S104).

(15) The transfer sheet P is fed out in the direction of conveyance by the registration roller 21 until the first leading edge detecting sensor 23A detects the leading edge of the transfer sheet P (S105 and S106).

(16) Subsequent to image formation on the front surface, the intermediate transfer belt 33 rotates. Then, the toner image to be formed on the rear surface and the intermediate transfer member reference mark A11 are transferred onto the intermediate transfer belt 33 by the toner image forming section 31 (S105*a*).

(17) Since the transfer sheet reference mark A12 has already been transferred onto the front surface of transfer sheet P, the detecting sensor 22 detects the transfer sheet reference mark A12, and goes to the process of correcting the position of the image on the front and rear surfaces, similarly to the case of the first embodiment.

(18) In response to the first leading edge detecting sensor 23A having detected the leading edge of the transfer sheet P, the registration roller 21 temporarily stops the conveyance of the transfer sheet P. The detecting sensor 22 detects the position X of the transfer sheet reference mark A12 of the transfer sheet P. Further, the intermediate transfer belt 33 is fed toward the secondary transfer roller 41, and the intermediate transfer member reference mark detecting sensor 32 detects the position Y of the intermediate transfer member reference mark A11 transferred onto the intermediate transfer belt 33 (S107).

(19) The amount ΔZ of correcting the position of the transfer sheet P across the width is calculated based on each of positions X and Y of the intermediate transfer member reference mark All and transfer sheet reference mark A12 detected by the computation section 80 (S108).

(20) The registration roller 21 shifts the transfer sheet P by the amount of correction amount ΔZ and corrects the position of the transfer sheet P across the width. In this case, if the transfer sheet P has a longer size in the direction of conveyance, the sheet feed roller 12 is released, whereby the position can be corrected (S109).

(21) The registration roller 21 releases the stop of the transfer sheet P, and feeds out the transfer sheet P in the direction of conveyance until second leading edge detecting sensor 23B detects the leading edge of the transfer sheet P (S110 and S11).

(22) Synchronously with the leading edge, the registration roller 21 feeds out the transfer sheet P toward the secondary transfer section 40 (S112).

(23) The transfer section 40 transfers the image onto the transfer sheet P (S113).

(24) The fixing section 50 fixes the image in position (S114).

(25) The sheet ejection section 70 ejects the transfer sheet P to terminate the process of image formation (S115).

In the image forming apparatus of this embodiment, the position of the transfer sheet P across the width is corrected, whereby the image is always kept within a predetermined distance from the sheet edge. Further, this ensures high-precision adjustment of the positions of the images on the front and rear surfaces without misalignment. Thus, this arrangement ensures high-precision adjustment of the positions of the images on the front and rears surfaces over a plurality of pages.

It should be noted that the control section 110 is made up of a memory for storing the programs in conformity to the operation flow with reference to the aforementioned first through third embodiments, and a CPU for executing these programs.

In the image forming apparatus of the first embodiment, based on the position of the transfer sheet reference mark created on the front surface of the transfer sheet, and the position of the toner image for transfer of the image on the rear surface and the intermediate transfer member reference mark transferred onto the intermediate transfer member, the position of the transfer sheet across the width in the formation of an image on the rear surface is corrected immediately before transfer of the image from the intermediate transfer member. This arrangement reduces the misalignment of the images across the width on the front and rear surfaces of the transfer sheet in the formation of images. This ensures high-precision adjustment of the image positions on the front and rear surfaces.

In the image forming apparatus of the second embodiment, the position of the transfer sheet across the width is corrected immediately before transfer of an image from the intermediate transfer member. At the same time, the misalignment of the toner image due to coasting of the intermediate transfer member is also corrected. Thus, this arrangement reduces the misalignment across the width over various pages in the process of image formation. This ensures that the image to be formed on the transfer sheet is kept within a predetermined distance from the edge across the width.

In the image forming apparatus of the third embodiment, the position across the width over various pages in the process of image formation is corrected. At the same time, the positions of the images on the front and rear surfaces across the width on one and the same page can also be corrected. Thus, this arrangement ensures high-precision adjustment of the positions of the images on the front and rears surfaces over a plurality of pages.

What is claimed is:

1. An image forming apparatus comprising:

a toner image forming section for forming a toner image;

an intermediate transfer member on which the toner image is to be transferred;

an intermediate transfer member-marking section for forming a first intermediate transfer member reference mark on said intermediate transfer member before transferring the toner image onto the intermediate transfer member;

a storage section for storing a position of the first intermediate transfer member reference mark in a width direction of the transfer sheet which is perpendicular to a direction of conveying the transfer sheet of the first intermediate transfer member reference mark;

an intermediate transfer member reference mark detecting section for detecting a position of the first intermediate transfer member reference mark transferred on said intermediate transfer member subsequent to transfer of the toner image onto said intermediate transfer member;

a sheet edge position detecting section for detecting a position, in the width direction, of one side edge of the transfer sheet having been conveyed;

a calculation section for calculating (a) an amount of misalignment of the transfer sheet in the width direction, based on information on a width of the transfer sheet in the width direction and the position of the one side edge of the transfer sheet; (b) an amount of misalignment of said intermediate transfer member in the width direction, based on the position of the first intermediate transfer member reference mark stored in said storage section, and the position of the detected first, intermediate transfer member reference mark, and (c) an amount of position correction of a front surface of the transfer sheet in the width direction, based on the amount of misalignment of the intermediate transfer member and the amount of misalignment of a rear surface of the transfer sheet;

a position correction section for correcting by shifting the transfer sheet in the width direction based on the amount of position correction of the front surface of the transfer sheet in the width direction; and a transfer-marking section for transferring onto the front surface of the transfer sheet the toner image and the first reference mark on said intermediate transfer member, wherein said intermediate transfer member-marking section forms a second intermediate transfer member reference mark on said intermediate transfer member in a time period from transferring the toner image onto the front surface of the transfer sheet to completing a transfer of a toner image for the rear surface of the transfer sheet onto said intermediate transfer member;

said sheet edge position detecting section detects a position of the first reference mark transferred on the front surface of the transfer sheet and a position of the transfer sheet in the width direction of the front surface of the transfer sheet having been reversed and conveyed;

said intermediate transfer member reference mark detecting section detects a position, in the width direction, of the second intermediate transfer member reference mark on the intermediate transfer member;

said calculation section calculates an amount of position correction on the rear surface in the width direction, based on the position of the detected first reference mark on the front surface of the transfer sheet and the position of the second intermediate transfer member reference mark; and said position correction section corrects by shifting the transfer sheet in the width direction, based on the amount of position correction on the rear surface of the transfer sheet.

* * * * *